US007054584B2

(12) United States Patent
Hirobe

(10) Patent No.: US 7,054,584 B2
(45) Date of Patent: May 30, 2006

(54) DEVELOPING APPARATUS WITH FIRST AND SECOND DEVELOPING BEARING MEMBERS EACH INCLUDING A MAGNETIC FIELD GENERATOR WHEREIN A PEAK POSITION MAGNETIC FORCE OF THE SECOND DEVELOPING MEMBERS IS A DEFINED VALUE

(75) Inventor: Fumitake Hirobe, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/166,111

(22) Filed: Jun. 27, 2005

(65) Prior Publication Data

US 2005/0238393 A1 Oct. 27, 2005

Related U.S. Application Data

(62) Division of application No. 10/704,689, filed on Nov. 12, 2003, now Pat. No. 6,993,274.

(30) Foreign Application Priority Data

Nov. 14, 2002 (JP) ..... 2002-330928

(51) Int. Cl.
*G03G 15/09* (2006.01)

(52) U.S. Cl. ..... 399/269

(58) Field of Classification Search ..... 399/267, 399/269, 277

See application file for complete search history.

(56) References Cited

U.S. PATENT DOCUMENTS

| | | | | |
|---|---|---|---|---|
| 3,543,720 | A | 12/1970 | Drexler et al. | 118/637 |
| 4,177,757 | A | 12/1979 | Murakawa et al. | 118/658 |
| 4,679,527 | A | 7/1987 | Chang | 118/658 |
| 4,912,511 | A | 3/1990 | Murasaki | 355/245 |
| 5,402,215 | A | 3/1995 | Yamaji | |
| 5,545,840 | A | 8/1996 | Doi et al. | 118/658 |
| 5,923,933 | A | 7/1999 | Anzai et al. | 399/269 |
| 6,330,405 | B1 | 12/2001 | Ishii et al. | 399/55 |
| 6,397,031 | B1 | 5/2002 | Itoh | 399/269 |
| 2002/0044797 | A1 | 4/2002 | Itoh | 399/269 |

FOREIGN PATENT DOCUMENTS

| | | |
|---|---|---|
| JP | 62-280881 | 12/1987 |
| JP | 5-204248 | 8/1993 |

*Primary Examiner*—Sandra L. Brase
(74) *Attorney, Agent, or Firm*—Fitzpatrick, Cella, Harper & Scinto

(57) ABSTRACT

A developing apparatus for developing an electrostatic image formed on an image bearing member includes a first developer bearing member for bearing magnetic developer to transport it to a first developing portion, a first magnetic field generator stationarily provided in the first developer bearing member, a second developer bearing member for bearing magnetic developer to transport it to a second developing portion, and a second magnetic field generator stationarily provided in the second developer bearing member. The first developer bearing member and the second developer bearing member supply the magnetic developer to the electrostatic image on the image bearing member in the mentioned order. In addition, a peak value of a normal line direction component of a magnetic force generated in the vicinity of the second developing portion is greater than a peak value of a normal line direction component of a magnetic force generated in the vicinity of the first developing portion.

4 Claims, 7 Drawing Sheets

DEVELOPING APPARATUS WITH FIRST AND SECOND DEVELOPING BEARING MEMBERS EACH INCLUDING A MAGNETIC FIELD GENERATOR WHEREIN A PEAK POSITION MAGNETIC FORCE OF THE SECOND DEVELOPING MEMBERS IS A DEFINED VALUE

CROSS-REFERENCE TO RELATED APPLICATION

This application is a divisional of application Ser. No. 10/704,689, filed Nov. 12, 2003 now U.S. Pat. No. 6,993, 274.

BACKGROUND OF THE INVENTION

1. Field of the Invention

The present invention relates to a developing apparatus for use in an apparatus utilizing an electrophotography method or electrostatic recording method such as a copying machine, a printer, a facsimile machine or the like.

2. Related Background Art

In the image forming apparatus using an electrophotography method such as a copying machine or the like, an electrostatic latent image formed on an image bearing member such as a photosensitive drum or the like is visualized with a developer applied thereto. The developer includes a magnetic single component developer including a magnetic toner, a non-magnetic single component developer including a non-magnetic toner or a two component developer including a non-magnetic toner and a magnetic carrier, one of which will be used in compliance with circumstances.

Among conventional apparatuses that are used in connection with the aforementioned developers, an apparatus that uses a two component developer including a toner and a carrier is shown in FIG. 7. Many developing apparatuses using two component developer like the developing apparatus 102 shown in FIG. 7 have a single sleeve developing apparatus structure including a single developing sleeve 8 serving as a developer bearing member and transporting screws 5 and 6 serving as transporting means for transporting the two component developer while agitating it.

In such a developing apparatus, a blank area in an image sometimes occurs. The blank area (edge effect) is one of the adverse effects on images caused by edge enhancement.

In the following, the mechanism of generation of the blank area will be described with reference to FIG. 8. The description will be directed to the case in which a reversal development method is used. In general, a blank area in an image appears at a boundary of a highlight image portion and a solid image portion in a halftone image. Specifically, the blank area appears at a position between the trailing edge of the highlight image portion and the leading edge of the solid image portion. FIG. 8 shows the state of equipotential surfaces and electric flux lines in the case that a highlight portion is present on a photosensitive drum and a solid portion is present on the trailing side of the highlight portion, wherein the boundary portion between the highlight portion and the solid portion is opposed to a developing sleeve. It will be understood from FIG. 8 that the electric flux lines at the boundary portion are greatly attracted toward the solid portion.

Therefore, in the structure used in connection with the conventional developing method in which the developing sleeve is rotated in the forward direction, toner contained in the supplied developer is not supplied to the trailing edge of the highlight portion but supplied to the solid portion for development along the electric flux lines. Thus, it is considered that a blank area sometimes occurs at the trailing edge of the highlight portion.

In order to avoid the aforementioned blank area in an image, there has been proposed a twin sleeve developing method in which two developing sleeves are provided in the upstream side and the downstream side with respect to the rotation direction of the photosensitive drum respectively and the same single electrostatic latent image on the photosensitive drum is developed by a first developing process using the developing sleeve on the upstream side and a second developing process using the developing sleeve on the downstream side. In this twin sleeve developing method, the potential difference between the highlight portion and the solid portion is decreased in the first developing process and the trailing edge area of the highlight portion is sufficiently developed in the second developing process. Therefore, the blank area is rarely generated in the twin sleeve developing method.

However, in the aforementioned conventional developing apparatus, among a plurality of magnetic poles of magnets provided in the interior of the developing sleeve on the downstream side, the magnetic pole closest to the photosensitive drum (the so-called developing magnetic pole) provides a magnetic flux density substantially equal to the magnetic flux density of the developing magnetic pole of the developing sleeve on the upstream side, so that the bristles or the so-called magnetic brush made by the developer has a length equal to the length of the magnetic brush on the upstream side. Consequently, the toner image that has been developed in the first developing process by the developing sleeve on the upstream side is rubbed by the magnetic brush again in the second developing process by the developing sleeve on the downstream side with a substantially equal pressure. In that case, a scavenging phenomenon can occur, and image quality is sometimes greatly deteriorated.

In order to solve the above-described problem, in recent years, utilization of a carrier with a high magnetization and a low resistance as a magnetic carrier in the developer has been contemplated. First, with a reduction of the magnetization amount of the carrier, the length of the magnetic brush can be decreased, so that a force with which the magnetic brush rubs the toner image developed on the photosensitive drum is weakened. Thus, it is possible to enhance image quality. In addition, with an increase in the resistance, leakage of the charge is eliminated even in the case that the charge of the latent image on the photosensitive drum is rubbed by the magnetic carrier. Therefore, enhancement of image quality is attained for the reason that the digital electrostatic latent image is not disturbed.

However, in the case that the magnetization amount is reduced and the developing sleeve and the photosensitive drum are rotated in the respective forward directions, the length of the magnetic brush will become short and the nip width (in the circumferential direction) throughout which the developer is in contact with the photosensitive drum will become narrow. As a result, edge enhancement such as so-called sweeping-together, which is the phenomenon that the density of the trailing edge of a solid image portion is increased, becomes visible. In addition, with an increase in the volume resistance of the magnetic carrier, there arises a problem that the opposed electrode effect is weakened and the blank area level (or the degree of appearance of blank areas) is made worse.

In addition, since the magnetic carrier, the toner on which has been consumed, has an electric charge with the polarity reverse to the charge of the toner (so-called counter charge), in the case that the magnetic carrier, the toner on which has been consumed, stays in the developing nip for a long time, it has an effect of unsticking the toner developed on the photosensitive drum (that is, a scavenging effect caused by the counter charge). This may possibly bring about the situation that the blank area level is made worse. Especially, in the case that the aforementioned carrier with a high resistance is used, the above-mentioned situation becomes notable since a charge decay time is required.

SUMMARY OF THE INVENTION

An object of the present invention is to provide a developing apparatus that can form high quality images using a first developer bearing member and a second developer bearing member.

Another object of the present invention is to provide a developing apparatus that can eliminate generation of defective images that can be generated if a toner image on an image bearing member that has been developed by a first developer bearing member is disturbed by developer on a second developer bearing member.

According to the present invention, there is provided a developing apparatus for developing an electrostatic image formed on an image bearing member comprising:

a first developer bearing member for bearing magnetic developer to transport it to a first developing portion;

first magnetic field generating means stationarily provided in the first developer bearing member;

a second developer bearing member for bearing magnetic developer to transport it to a second developing portion; and second magnetic field generating means stationarily provided in the second developer bearing member;

wherein the first developer bearing member and the second developer bearing member supply the magnetic developer to the electrostatic image on the image bearing member in the mentioned order; and the peak value of the normal line direction component of a magnetic force generated in the vicinity of the second developing portion is larger than the peak value of the normal line direction component of a magnetic force generated in the vicinity of the first developing portion.

Furthermore, according to the present invention, there is also provided a developing apparatus for developing an electrostatic image formed on an image bearing member, comprising:

a first developer bearing member having a cylindrical shape for bearing magnetic developer;

first magnetic field generating means stationarily provided in the first developer bearing member;

a second developer bearing member having a cylindrical shape for bearing magnetic developer;

second magnetic field generating means stationarily provided in the second developer bearing member;

wherein the first developer bearing member and the second developer bearing member supply the magnetic developer to the electrostatic image on the image bearing member in the mentioned order; and the position at which a magnetic force in the direction orthogonal to the surface of the second developer bearing member has its peak is arranged to be at a position that is in the vicinity of a portion closest to the image bearing member and away from the portion closest to the image bearing member by a predetermined amount in the downstream direction with respect to the moving direction of the second developer bearing member.

Still further, according to the present invention there is provided a developing apparatus for developing an electrostatic image formed on an image bearing member, comprising:

a first developer bearing member for bearing magnetic developer to transport it to a first developing portion;

first magnetic field generating means stationarily provided in the first developer bearing member;

a second developer bearing member for bearing magnetic developer to transport it to a second developing portion; and second magnetic field generating means stationarily provided in the second developer bearing member;

wherein the first developer bearing member and the second developer bearing member supply the magnetic developer to the electrostatic image on the image bearing member in the mentioned order; and the circumferential length along which the magnetic developer on the second developer bearing member is in contact with the image bearing member is shorter than the circumferential length along which the developer on the first developer bearing member is in contact with the image bearing member.

These and other features and objects of the present invention will become apparent by reading the following detailed description of the present invention with reference to the accompanying drawings.

DESCRIPTION OF THE PREFERRED EMBODIMENTS

In the following, a developing apparatus according to the present invention and an image forming apparatus will be specifically described with reference to the accompanying drawings.

Embodiment 1

A developing apparatus to which the present invention can be applied is a developing apparatus in which an electrostatic image formed on an image bearing member is developed with a magnetic developer by a first developer bearing member and a second developer bearing member that include magnetic field generating means respectively (namely, one electrostatic image is subjected to two developing processes). Especially, in the case of a developing apparatus that uses a developer including a non-magnetic toner and a magnetic carrier, magnetic brushes magnetically formed on the first developer bearing member and the second developer bearing member respectively are brought into contact with the electrostatic image on the image bearing member so that the electrostatic image is developed. The magnetic carrier has characteristics of triboelectrically charging the non-magnetic toner. The "triboelectric charging" is performed while the developer is circulated in a developing container while being agitated and transported.

An image forming apparatus in which the aforementioned developing apparatus is used may be composed of a photosensitive member such as an organic photoconductor serving as an image bearing member, a charging apparatus such as a corona charger for charging the image bearing member, an exposure apparatus for performing exposure to form an electrostatic latent image corresponding, for example, to an image of an original to be copied, a transferring apparatus for transferring a developer image (or a toner image) formed by the developing apparatus onto a transferring material such as a normal paper sheet, a fixing device for fixing unfixed toner that has been transferred with application of heat and pressure, and a cleaning device for removing toner remaining on the image bearing member after the transferring.

For example, the developing apparatus may be used in the image forming apparatus that will be described in the following, but the aspect of the apparatus in which the developing apparatus is used is not limited to that particular apparatus.

Figure 1:
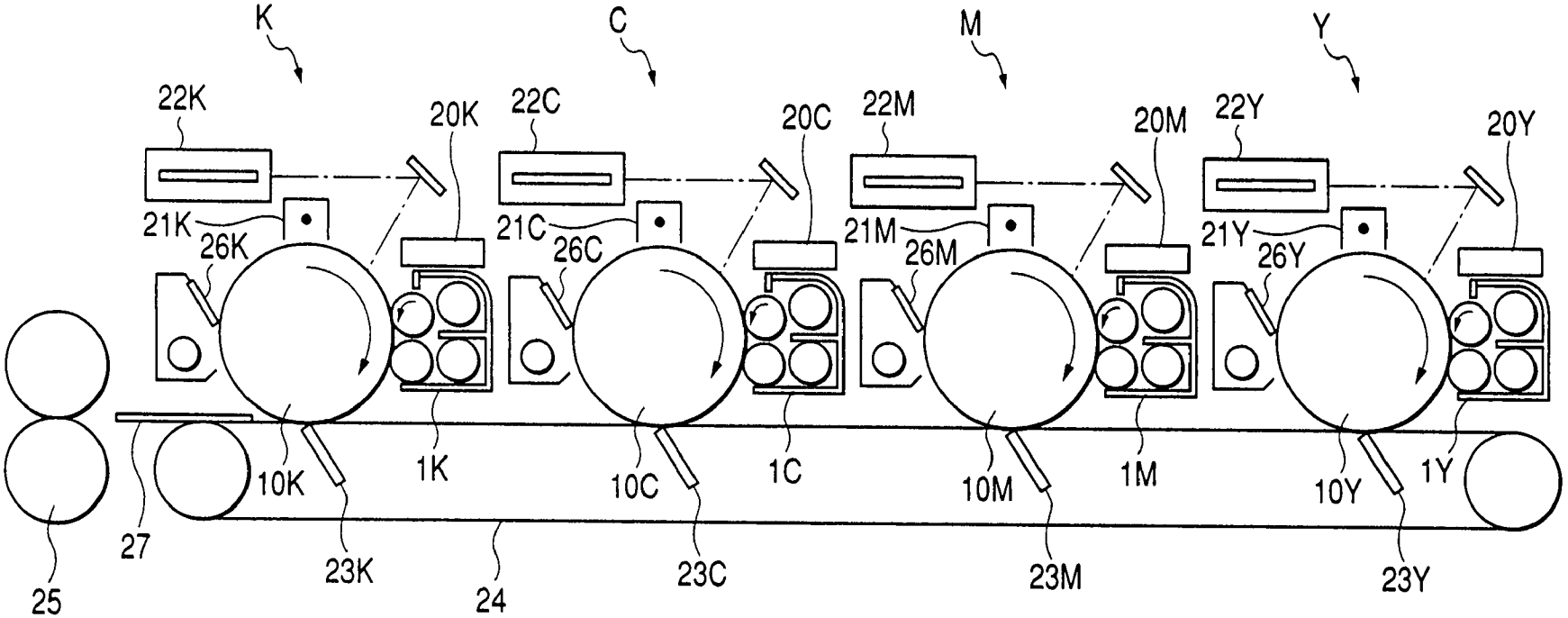
FIG. 1 is a schematic diagram showing an example of an image forming apparatus according to the present invention.

FIG. 1 shows an image forming apparatus utilizing an electrophotography method according to an embodiment of the present invention. FIG. 1 shows a positional relationship between image bearing members (i.e., photosensitive drums) 10Y, 10M, 10C and 10K and developing apparatuses 1Y, 1M, 1C and 1K in respective stations Y, M, C and K provided in the full color image forming apparatus. The stations Y, M, C and K have substantially the same structure and form yellow (Y), magenta (M), cyan (C) and black (K) images, respectively, for full color image formation.

It should be understood that in the following description, expressions like "developing apparatus 1", for example, will collectively refer to the developing apparatus 1Y, the developing apparatus 1M, the developing apparatus 1C and the developing apparatus 1K in the respective stations Y, M, C and K.

Firstly, the overall operation of the image forming apparatus will be described with reference to FIG. 1. A photosensitive drum 10 serving as the image bearing member is rotatably mounted. The photosensitive drum 10 is uniformly charged by a primary charger 21 and subjected to exposure with light such as a laser beam that has been modulated by a light emitting element 22 in accordance with an image information signal, so that an electrostatic latent image is formed on the photosensitive drum 10.

The electrostatic latent image is visualized by the developing apparatus 1 as a developed image (or a toner image) through a developing process that will be described later. The toner images formed on the photosensitive drums in the respective stations are sequentially transferred from the photosensitive drums onto a transferring paper sheet 27 that has been conveyed, with the aid of first transferring chargers 23. The toner images on the transferring paper sheet 27 are fixed by a fixing device 25, so that a permanent image is formed. Transfer residual toner remaining on the photosensitive drum 10 is removed by a cleaning device 26.

The consumed toner in the developer that has been consumed in the developing process is occasionally replaced from a toner replenishing tank 20 so that the toner density in the developing apparatus will be appropriately controlled.

While the above description is directed to the process in which the toner images are transferred from the photosensitive drums 10M, 10C, 10Y and 10K directly onto a transferring paper sheet 27 serving as a recording material on a transferring paper sheet conveying sheet 24, the present invention can be applied to an image forming apparatus that is provided with an intermediate transferring member in place of the transferring paper sheet conveying sheet 24 so that the toner images of the respective colors on the photosensitive drums 10M, 10C, 10Y and 10K for the respective colors are primarily transferred onto the intermediate transferring member sequentially and then the composite toner image composed of the respective colors is secondarily transferred from the intermediate transferring member onto a transferring paper sheet.

Next, the operation of the developing apparatus 1 will be described with reference to FIG. 2. The developing apparatus 1 according to the present invention has a developing container 2 containing magnetic developer including non-magnetic toner and magnetic carrier, in which transporting screws 5 and 6 for agitating and transporting the developer and a first developing sleeve 8 serving as a first developer bearing member and a second developing sleeve 9 serving as a second developer bearing member opposed to each other are provided. In addition, the developing apparatus 1 has a regulating blade 11 serving as a developer regulating member for regulating the thickness of the developer borne on the surface of the developing sleeve 8.

More specifically, the developer 1 is provided with a developing container 2, and the developing sleeves 8 and 9 serving as developer bearing members are provided one above the other and rotatably supported at the opening of the developing container 2 that faces the photosensitive drum 10.

The developing sleeves 8 and 9 are adapted to have the same rotation direction and substantially the same rotation speed (i.e. the circumferential speed).

In the interior of the developing container 2 opposite to the opening, there is provided a developing chamber 3 and an agitating chamber 4 partitioned by a partition 7 one above the other. The first and the second transporting screws 5 and 6 functioning as means for agitating and transporting the developer are respectively provided in the developing chamber 3 and the agitating chamber 4, which form a circulating path of the developer. The first transporting screw 5 transports the developer in the developing chamber 3, and the second transporting screw 6 transports the toner supplied at the upstream of the second transporting screw 6 from a toner replenishing port (not shown) into the interior of the agitating chamber 4 and the developer that has been present in the agitating chamber 4 while agitating the toner and the developer.

The developer supplied from the developing chamber 3 to the agitating chamber 4 by the gravitational force through an opening portion provided on the partition 7 at a position close to an axial end of the first and the second transporting screws is picked up onto the developing sleeve 8 by a magnetic pole N1 (which is at a position in the interior of the developing container 2) of a magnet roller 8' serving as a first magnetic field generating means that is non-rotatably provided in the developing sleeve 8. As the developing sleeve 8 is rotated, the developer is transported on the surface of the developing sleeve 8 to a magnetic pole S1 and then to a magnetic pole N2. In this way, the developer is delivered to the developing portion in the vicinity of the developing magnetic pole S2 at which the developing sleeve 8 and the photosensitive drum 10 are opposed to each other. While transported in the above-described manner, the developer is magnetically regulated in its layer thickness by the developer regulating blade 11 in cooperation with the magnetic pole S1 at the position substantially opposed to the developer regulating blade 11, so that the developer is formed into a thin layer. Thus, a first developing process is performed on an electrostatic latent image formed on the photosensitive drum 10 in the first developing portion 12.

After that, the developer is transferred from a magnetic pole N3 positioned downstream of the first developing portion 12 with respect to the rotation direction of the developing sleeve 8 to a magnetic pole S3 of a magnet roller 9' serving as a second magnetic field generating means that is non-rotatably provided in the developing sleeve 9. Then, the developer is delivered to a second developing portion 13 in the vicinity of the developing magnetic pole N4 at which the developing sleeve 9 and the photosensitive drum 10 are opposed to each other, so that the developer is used again for the second developing process for the electrostatic latent image on the photosensitive drum 10.

The remaining developer that has not been used in the development in the second developing portion 13 is transported into the interior of the developing container 2 via magnetic poles S4→N5→S5 disposed downstream of the developing portion 13 with respect to the rotation direction of the developing sleeve 9 in the mentioned order, and then the remaining developer is removed from the developing sleeve 9 by a repulsive magnetic field generated by magnetic poles S3 and S5. Thus, the developer is collected into the agitating chamber 4 in the lower portion of the developing container 2.

The collected developer is transported by the transporting screw 6 toward the other end while agitated so that the developer is sufficiently blended with supplied toner, and then the developer is transferred into the developing chamber 3 through a communicating path. The developer transferred into the developing chamber 3 is transported and agitated by the transporting screw 5 so as to be supplied to the developing sleeve 8. As per the above, the developer is circulated in the above-described structure.

In the present invention, the developing apparatus is provided at least with rotatable non-magnetic cylinder members (i.e. the developing sleeves) serving as a plurality of developer bearing members opposed to an image bearing member and magnet rollers serving as magnetic field generating means stationarily disposed in the interior of the nonmagnetic cylinder members, as is the case with this embodiment.

It is preferable that the non-magnetic cylinder members in the form of the developing sleeves 8 and 9 be made of an electrically conductive material. Such a material may be a conventionally known material such as a metal like a stainless steel or aluminum, etc., or a resin to which electric conductivity is given by dispersion of electrically conductive particles, for example. The non-magnetic cylinder may be subjected to a processing such as abrasive blasting for roughing the surface in order to enhance its developer transporting ability. In this embodiment, substantially the same roughing processing is performed on the surface of the developing sleeves 8 and 9, so that the developing sleeves 8 and 9 have substantially the same surface roughness.

Referring to the magnet rollers 8' and 9' serving as the magnetic field generating means, a plurality of magnetic poles are fixed in the interior of the non-magnetic cylinders so that the magnetic poles are immovable relative to the non-magnetic cylinders. The magnetic field generating means may be either means like a permanent magnet or the like that always generates a magnetic field or means like an electromagnet or the like that can arbitrarily generate a constant magnetic field or magnetic fields of different polarities.

In this embodiment, a two component developer containing a non-magnetic toner and a carrier with a low magnetization and a high resistance that will be described in the following is used in the developing apparatus having the structure shown in FIG. 2.

The non-magnetic toner is composed of certain amounts of a binder resin such as a styrene resin or a polyester resin, a coloring agent such as a carbon black, a dyestuff or a pigment, a releasing agent such as a wax, and a charge control agent. Such a non-magnetic toner can be produced using ordinary processes such as grinding and polymerization, etc.

It is preferable that the non-magnetic toner (having negative charging properties) has a triboelectric charge amount of $-1\times10^{-2}$ to $-5.0\times10^{-2}$C/Kg. In the case that the triboelectric charge amount of the non-magnetic toner is out of the aforementioned range, development efficiency will be lowered and the blank area level will be deteriorated due to an increase in the amount of the counter charge generated in the magnetic carrier. Thus, a defective image may sometimes be formed. The triboelectric charge amount of the non-magnetic toner may be adjusted by selecting the kind of the used material or by adding an external additive that will be described later.

The triboelectric charge amount of the non-magnetic toner can be measured using an ordinary blow-off method to suck toner from developer of an amount of 0.5 to 1.5 g and measuring the charge induced in the measurement container.

As the magnetic carrier, conventionally known carriers may be used. For example, a resin carrier in which a magnetite is dispersed as a magnetic material and carbon black is dispersed for imparting conductivity and for resistance adjustment, a magnetite simple substance such as a ferrite whose surface is processed by oxidization and reduction for resistance adjustment, or a magnetite simple substance such as a ferrite whose surface is coated with a resin for resistance adjustment, etc., may be used. There is no particular restriction for production methods of this magnetic carrier.

It is preferable that the magnetic carrier has a magnetization of $3.0\times10^4$ A/m to $2.0\times10^5$ A/m under a magnetic field of 0.1 tesla. In the case that the magnetization of the magnetic carrier is made small, an effect of suppressing scavenging by a magnetic brush is attained, but adhesion of the magnetic carrier to the non-magnetic cylinder by the aid of magnetic field generating means becomes difficult, so that an image defect due to adhesion of the magnetic carrier to the photosensitive drum or the aforementioned sweeping-together phenomenon in an image sometimes occurs. On the other hand, in the case that the magnetization of the magnetic carrier is larger than the above-mentioned range, an image defect due to a pressure applied by a magnetic brush is sometimes generated as described before.

In addition, in view of leakage and development efficiency, it is preferable that the volume resistance of the magnetic carrier be in the range of $10^7$ to $10^{14}$ Ωcm.

The magnetization of the carrier was measured using an oscillating magnetic field magnetic property automatic recording apparatus BHV-30 manufactured by Riken Denshi Co., Ltd. Upon measuring a magnetic property value of the carrier powder, an external magnetic field of 0.1T is generated and the intensity of magnetization is measured under that state. The carrier is packed in a plastic container having a cylindrical shape under a sufficiently dense state. Under that state, the magnetization moment is measured and the actual weight when a sample is packed is measured, so that the intensity of magnetization is determined ($Am^2/kg$). After that, the absolute specific gravity of the carrier particle is measured by a dry type automatic density meter Accupyc 1330 manufactured by Shimadzu Corporation. The intensity of magnetization per unit volume (A/m) used in the present invention can be obtained as the intensity of magnetization ($Am^2/kg$) times the absolute specific gravity.

According to the present embodiment, in a developing apparatus having two developer bearing members as described above and provided with two developing portions so that generation of blank areas can be avoided while enhancing development efficiency and using a two component developer containing a carrier having a low magnetization and a high resistance so that high quality images can be obtained, a toner image formed in the first developing process is prevented from being disturbed in the second developing process by controlling the peak intensity and the peak position of a magnetic force acting on the developer borne on each developing sleeve by each magnetic field generating means.

Specifically, image defects such as blank areas are intended to be avoided by relieving problems such as the sweeping-together phenomenon or the scavenging phenomenon caused in the second developing process by a magnetic brush on the second sleeve.

There is no particular limitation on the image forming apparatus so long as the apparatus uses a process of developing an electrostatic latent image formed on an image bearing member so as to record an image on a paper sheet or the like. Therefore, conventionally known image forming processes, such as electrophotography or electrostatic recording, may be adopted in the image forming apparatus.

Next, magnetic fields generated by the first and the second magnetic field generating means (i.e. magnet rollers 8' and 9') provided in the first and the second developer bearing members (i.e. the developing sleeves 8 and 9), which constitute characterizing features of the present invention, will be described in the following.

Figure 2:
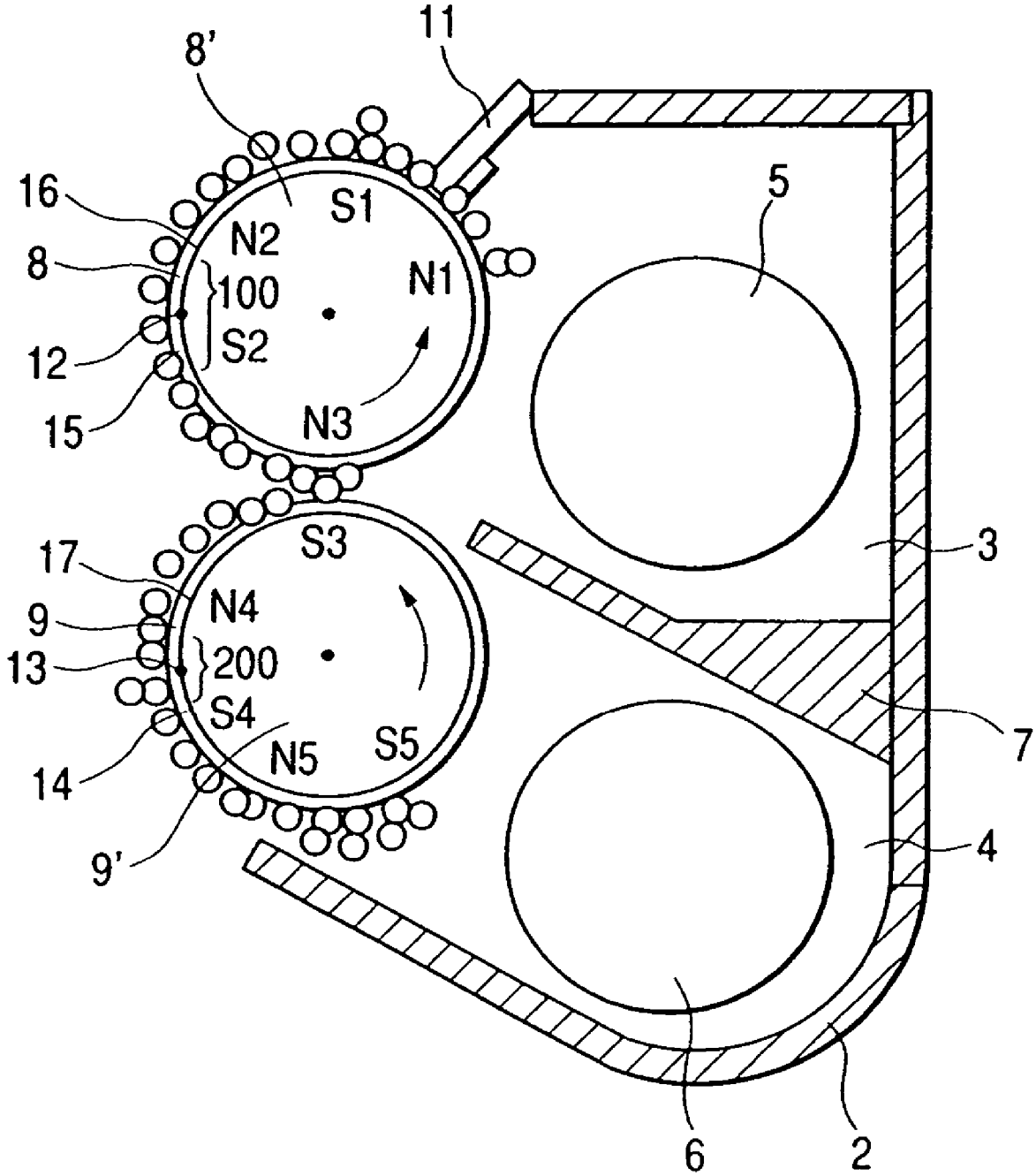
FIG. 2 is a cross-sectional view schematically showing an example of a developing apparatus according to the present invention.

In this embodiment, among magnetic forces F (vectors) generated by the magnet rollers 8' and 9' at arbitrary positions on the surface of the developing sleeves 8 and 9 serving as non-magnetic cylinders shown in FIG. 2, a magnetic force Fr1 generated by the magnet roller 8' as a component in the direction orthogonal to the circumferential surface of the developing sleeve 8 (i.e. in the normal line direction) has its peak substantially at the position of the portion 12 closest to the photosensitive drum 10 (i.e. the first developing portion). On the other hand, a magnetic force Fr2 generated by the magnet roller 9' as a component in the direction orthogonal to the circumferential surface of the developing sleeve 9 (i.e. in the normal line direction) has its peak at a position in the vicinity (or neighborhood) of the portion 13 substantially closest to the photosensitive drum 10 (i.e. the second developing portion) and away from the closest portion 13 by a predetermined distance in the downstream direction with respect to the rotation direction of the developing sleeve 9. In this embodiment, this peak position is the position designated by reference numeral 14.

In other words, assuming that the tangential components of intensities B (vectors) of magnetic fields (which may also be called magnetic flux densities) generated by the magnet rollers 8' and 9' at the portions 10 closest to the developing sleeves 8 and 9 among the intensities B of magnetic fields generated at arbitrary positions on the surface of the developing sleeves 8 and 9 are represented by Bθ1 and Bθ2 respectively, the peak positions of the gradient, with respect to the direction orthogonal to the respective developing sleeves 8 and 9, of the respective sums of the square of the absolute value of the magnetic flux density Br1, Br2 representing the force Fr1, Fr2 of the magnet roller 8', 9' and the square of the absolute value of the component Bθ1, Bθ2 are at positions 15 and 14 respectively that are away from the neighborhood of the respective closest portions (or developing portions) 12 and 13 in the downstream side with respect to the rotation direction of the developing sleeves 8 and 9.

Furthermore, the peak positions of Br1 and Br2 are at positions 16 and 17 in the vicinity of the closest portions (i.e. the developing portions) 12 and 13 respectively and away from the respective closest positions 12 and 13 in the upstream side with respect to the rotation direction of the developing sleeves 8 and 9.

The aforementioned upstream side with respect to the rotation direction of the developing sleeve 8, 9 away from the closest portion 12, 13 is within the angle of about 15 degrees from the position of the closest portion 12, 13 in the upstream direction.

In the following, the reason for the above-described conditions will be described.

The gradient of the sum of the square of the absolute value of the component Br1, Br2 and the square of the absolute value of the component Bθ1, Bθ2 with respect to the direction orthogonal to the circumferential surface of the developing sleeve 8, 9 represents a force (a magnetic attractive force) generated by the magnet roller 8', 9' fixed in the interior of the developing sleeve 8, 9 and attracting magnetic carrier (or a magnetic brush) that bears toner on the developing sleeve 8, 9.

The magnetic force Fr (Fr1, Fr2) (in units of Newton N) acting on one magnetic carrier particle in the direction orthogonal to the circumferential surface of the developing sleeve 8, 9 is represented by the following formula, where m (a vector) represents the magnetization of the magnetic carrier (the unit of |m| is A/m), V ($m^3$) represents the volume of one magnetic carrier particle, B (B=(Br, Bθ)) represents the intensity of magnetic field generated by the magnet roller 8', 9', A is a constant, and the direction toward the rotation center of the magnetic sleeve 8, 9 is taken as the positive (i.e. plus) direction:

$$\begin{aligned} Fr &= -A\nabla r(m\cdot B) \\ &= -Ad/dr(|m|VB\cdot B) \\ &= -|m|VAd/dr(B^2) \\ &= -|m|VAd/dr\{(Br)^2+(B\theta)^2\} \end{aligned}$$

In the above equation, since A is a constant, |m| is a function of the magnetic permeability, and r is set in the radial direction (i.e. the normal line direction) of the surface of the sleeve 8, 9, the direction of the force is the direction toward the center of the sleeve 8, 9.

Therefore, the first magnetic force Fr1 and the second magnetic force Fr2 are represented by the following formulas:

$$Fr1=A\cdot\nabla r\{(Br1)^2+(B\theta1)^2\}$$

$$Fr2=A\cdot\nabla r\{(Br2)^2+(B\theta2)^2\}$$

Therefore, the force Fr1, Fr2 acting at a position on the surface of the sleeve 8, 9 in the direction orthogonal to the surface of the sleeve 8, 9 is proportional to the gradient, with respect to the direction orthogonal to the circumferential surface of the developing sleeve 8, 9, of the sum of the square of the absolute value of the component Br and the square of the absolute value of the component Bθ (where, the direction toward the center of the sleeve is taken as the positive (or plus) direction).

Figure 3:
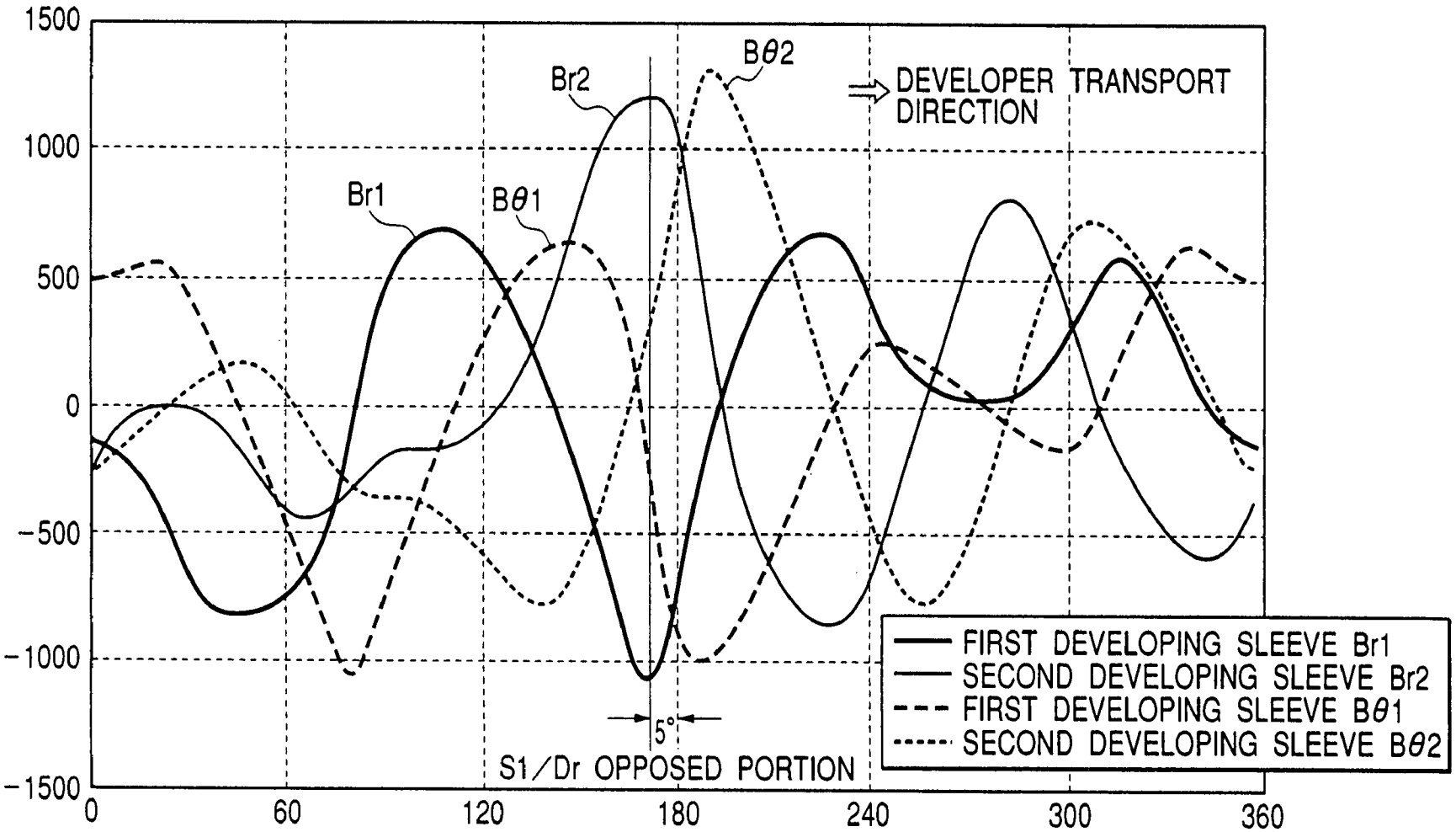
FIG. 3 is a graph showing intensity distribution of the magnetic field intensity B on the surface of a developer bearing member according to the present invention.

In connection with the present embodiment, an example of the intensity distributions, along the circumference of the respective developing sleeves 8 and 9, of the components Br and Bθ generated by the respective magnetic field generating means 8' and 9' is shown in FIG. 3. In addition, an example of the intensity distributions, along the circumference of the respective developing sleeves 8 and 9, of the forces Fr1 and Fr2, the magnetic force Fθ1 in the tangential direction acting on the first developing sleeve 8 and the magnetic force Fθ2 in the tangential direction acting on the second developing sleeve 9 is shown in FIG. 4.

The axis of ordinate on the left side is scaled in units of gauss (G), while the axis of ordinate on the right side represents the intensity in units of dimensionless number (a.u.). On the other hand, the axis of abscissa represents the position or the angle along the circumference of the developing sleeve 8, 9. In connection with this, the rotation direction of the developing sleeve 8, 9 is the direction from the left to the right in FIGS. 3 and 4. The "S1/Dr Opposed Position" shown in the graphs of FIGS. 3 and 4 refers to the closest portion 12, 13 of the developing sleeve 8, 9 with the photosensitive drum 10.

Figure 4:
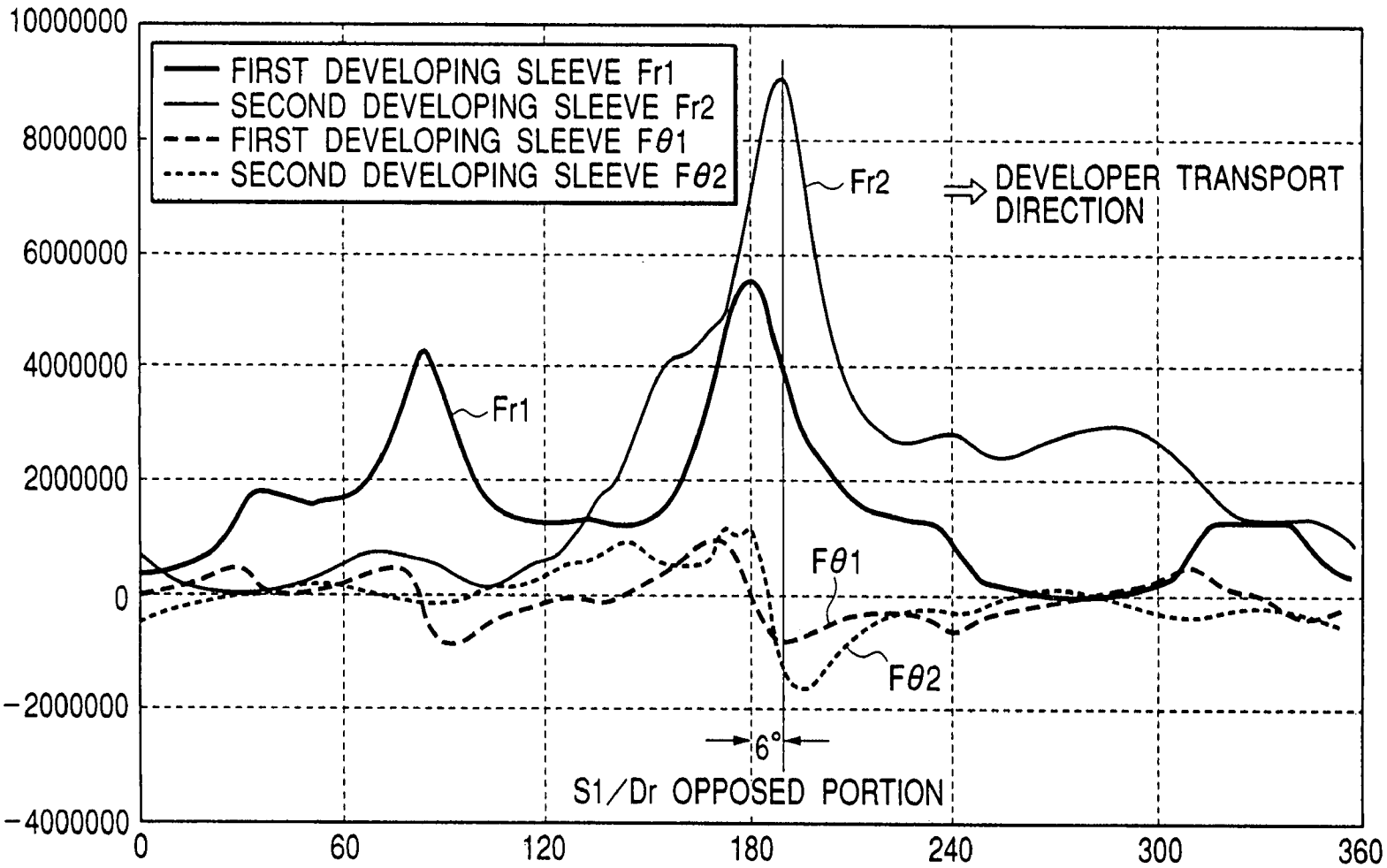
FIG. 4 is a graph showing intensity distribution of the magnetic force F on the surface of the developer bearing member according to the present invention.

As will be seen from FIG. 4, the peak of Fr2 is positioned a little downstream of the closest portion (or the S1/Dr opposed portion). At that peak position, Fθ shifts from the plus side to the minus side.

In connection with this, Fθ in the plus side means a force biasing the developer toward the peak position of Fr (i.e. a transporting force), while Fθ in the minus side means a carrying-back force (or a retaining force) for biasing the developer in the reverse direction. In the following the peak position of Fr will be referred to as the magnetic force reversal point.

As will be understood from FIG. 3, the peak of the gradient, with respect to the direction orthogonal to the circumferential surface of the developing sleeve 8, 9, of the sum of the square of the absolute value of the aforementioned component Br and the square of the absolute value of the aforementioned component Bθ is present at a position in the vicinity of the developing portion (or the closest portion) 12, 13 and in the downstream of the developing portion 12, 13 with respect to the rotation direction of the developing sleeve 8, 9. With this position of the peak, the force acting on the magnetic brush in the vicinity of the developing nip can be made maximum.

This means that the magnetic brush can be attracted toward the peak position of Fr located in the downstream of the developing portion with respect to the rotation direction of the non-magnetic cylinder. Therefore, it is possible with this structure to prevent the aforementioned magnetic brushes after completion of development from remaining in the respective developing nips 100 and 200 (shown in FIG. 2).

The developing nip means the area all along which the magnetic brush on the developing sleeve is in contact with the photosensitive drum. The magnetic fields generated by the aforementioned magnetic field generating means 8' and 9' are arranged in such a way that the length of the developing nip 200 in the circumferential direction is shorter than the length of the developing nip 100 in the circumferential direction.

The circumferential length of the developing nip can be determined by measuring the circumferential length of the magnetic brush that is in contact with the surface of the photosensitive drum 10 under the state in which the rotations of the developing sleeves 8 and 9 are stopped. This determination is based on the fact that in the case that the circumferential length of the developing nip 200 is shorter than the circumferential length of the developing nip 100 under the state in which the developing sleeves 8 and 9 are stopped, the same relationship is maintained under the state in which the developing operation is performed.

Particularly, in this embodiment, the peak values (absolute values) of the magnetic forces Fr1 and Fr2 generated by the magnetic field generating means 8' and 9' in the respective developing portion are adapted to meet the following relationship:

"peak value of Fr2">"peak value of Fr1".

With this relationship, it is possible to greatly improve the blank area level. In the following, a description will be made on this fact.

Firstly, the first developing process performed by the developing sleeve 8 is a process for developing an electrostatic latent image so as to cancel an electric potential difference between the highlight portion and the solid portion. Therefore, it is preferable to enhance development efficiency in this process. This can be attained by prolonging the effective development time, that is, by setting the circumferential length of the developing nip relatively long. On that account, it is possible to enhance development efficiency by allowing the magnetic brush to remain even after completion of development to prolong the development time.

This has been attained by reducing the peak value of the magnetic force Fr1 in the first developing portion 12.

However, in the case the developer is allowed to remain, the first developing process is finished under a state in which image deterioration occurs due to a counter charge generated in the magnetic carrier, as described before.

When the process proceeds to the second developing process performed by the developing sleeve 9 after the first developing process, since the electric potential difference between the highlight portion and the solid portion has been made small, an improvement in image quality is attained in the second developing process by virtue of rearrangement of toner in the toner image that has already been formed in the first developing process or by virtue of supply of toner to portions of the electrostatic latent image to which toner should be attached but has not been attached.

In addition, the circumferential length of the developing nip formed by the second developing sleeve is arranged to be relatively short, so that the effective developing time in the second developing process is set short.

Furthermore, the apparatus is designed in such a way that the toner image that has been formed in the first developing process is prevented from being unnecessarily disturbed by the magnetic brush in the second developing process.

Thus, by making the peak value of the magnetic force Fr2 in the second developing portion 13 larger than the peak value of the magnetic force Fr1 in the first developing portion 12, toner flies to a blank portion at the trailing edge of a highlight portion, and therefore it is possible to improve the blank area level to provide an image with an improved quality.

In the case that development efficiency in the first developing process is enhanced as is the case with the present embodiment, it is possible in the second developing process to develop an electrostatic latent image without taking a long developing time. Therefore, it is preferable that the apparatus is designed in such a way as to avoid, as much as possible, removal of developed toner from the photosensitive drum by detention of the magnetic brush having a counter charge after completion of development in the developing portion 13, contrary to the first developing process. For that purpose, the magnetic force acting on the developer at the trailing edge of the developing portion should be made large. This means that the magnetic force Fr should be made large.

In view of the above, in this embodiment the specific relationship between the magnetic force (i.e. the peak value of Fr1) in the first developing portion 12 and the magnetic force (i.e. the peak value of Fr2) in the second developing portion 13 is set as the above-described formula (or inequality).

That formula may be regarded as an expression of a developer transporting force up to the magnetic force reversal point, and it is possible to greatly reduce retention of the developer after completion of the developing process.

In connection with the above, it is preferable that the peak positions (i.e. the magnetic force reversal points) of the magnetic forces Fr1 and Fr2 be set at positions between the respective closest portions (or the respective developing portions) and the positions away from the respective closest portions in the downstream direction with respect to the rotation direction of the respective developing sleeves by an angle of 15 degrees (which is the angle formed by the line between the rotation center of the developing sleeve as the reference point and the closest portion and the line between the rotation center and the magnetic force reversal point).

This means that it is preferable that the magnetic force reversal point be provided in the downstream of the closest portion with respect to the rotation direction of the developing sleeve. In connection with this, the "magnetic force reversal point" implies the fact that in the area upstream of the above-described peak position of Fr with respect to the rotation direction of the developing sleeve, the magnetic force acts on the developer as a transporting force directed toward the normal direction, while in the area downstream of the peak position of Fr with respect to the rotation direction of the developing sleeve, the magnetic force acts on the developer as a retaining force.

In the case that the aforementioned peak position of Fr is displaced in the downstream direction with respect to the rotation direction of the developing sleeve beyond the position of the angle of 15 degrees, the magnetic brush will recline on the developing sleeve in the developing portion (namely, a failure in bristle erection will occur), so that development efficiency is sometimes deteriorated and the blank area avoiding effect sometimes becomes insufficient.

In view of separate functions of the developing processes with the twin sleeve structure (i.e. in the first developing process, development efficiency is enhanced and toner is applied to the most part of the electrostatic latent image, while in the second developing process, excess and deficiency of toner attachment to the electrostatic latent image is corrected for the toner image obtained in the first developing process (rearrangement of toner)), in the first sleeve 8 it is preferable that the magnetic force reversal point be arranged in the vicinity of the closest portion in order to allow the developer to remain to enhance development efficiency, while in the second developing sleeve 9 it is preferable that the magnetic force reversal point be arranged at a position in the downstream of the closest portion with respect to the rotation direction of the developing sleeve in order to prevent detention of the developer. With such arrangements, it is easily possible to attain both an improvement in development efficiency and prevention of scavenging at the same time.

In view of the above, it is more preferable that the peak position (or the magnetic force reversal point) of Fr1 be arranged between the position of the closest portion (0°) and the position 5 degrees away from the closest portion in the downstream direction with respect to the rotation direction of the first developing sleeve, that is:

$0° \leqq$ peak position of Fr1 $\leqq 5°$.

Similarly, it is more preferable that the peak position (the magnetic force reversal point) of Fr2 be arranged between the position 5 degrees away from the closest portion (0°) in the downstream direction with respect to the rotation direction of the second developing sleeve and the position 10 degrees away from the closest position in the downstream direction, that is:

$5° \leqq$ peak position of Fr2 $\leqq 10°$.

As per the above, it is preferable that the distance of the magnetic force reversal point in the second developing sleeve from the closest portion 13 in the downstream direction with respect to the rotation direction of the second developing sleeve (i.e. the angle formed by the line between the rotation center of the second developing sleeve as the reference point and the closest portion 13 and the line between the rotation center and the magnetic force reversal point) be made longer (larger) than the distance of the magnetic force reversal point in the first developing sleeve from the closest portion 12 in the downstream direction with respect to the rotation direction of the first developing sleeve (i.e. the angle formed by the line between the rotation center of the first developing sleeve as the reference point and the closest portion 12 and the line between the rotation center and the magnetic force reversal point).

With the above-described arrangement, it is possible to attain an improvement in development efficiency and prevention of scavenging, which are advantageous effects of the developing structure having the first developing sleeve and the second developing sleeve.

In the embodiment that will be described in the following, the first and the second developing sleeves have the same diameter of 20 mm, and therefore the distance along the circumference of the developing sleeve between the closest portion and the position 15 degrees away from the closest portion in the downstream direction with respect to the rotation direction of the non-magnetic cylinder is about 2.6 mm.

In this embodiment, the term "closest portion" refers to the position at which the surface of a non-magnetic cylinder and the surface of an image bearing member are opposed to each other with the smallest distance therebetween.

Figure 5:
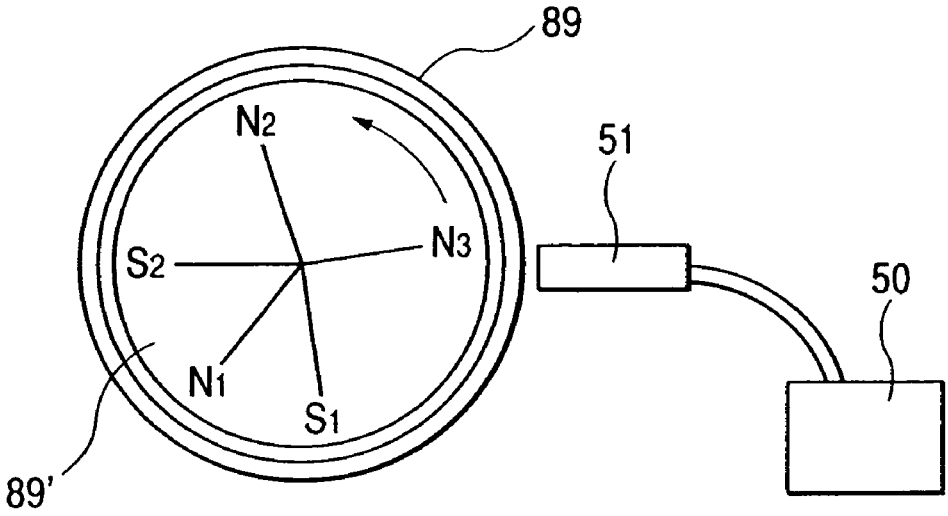
FIG. 5 illustrates a method of measuring a magnetic field on the developer bearing member according to the present invention.
Figure 6:
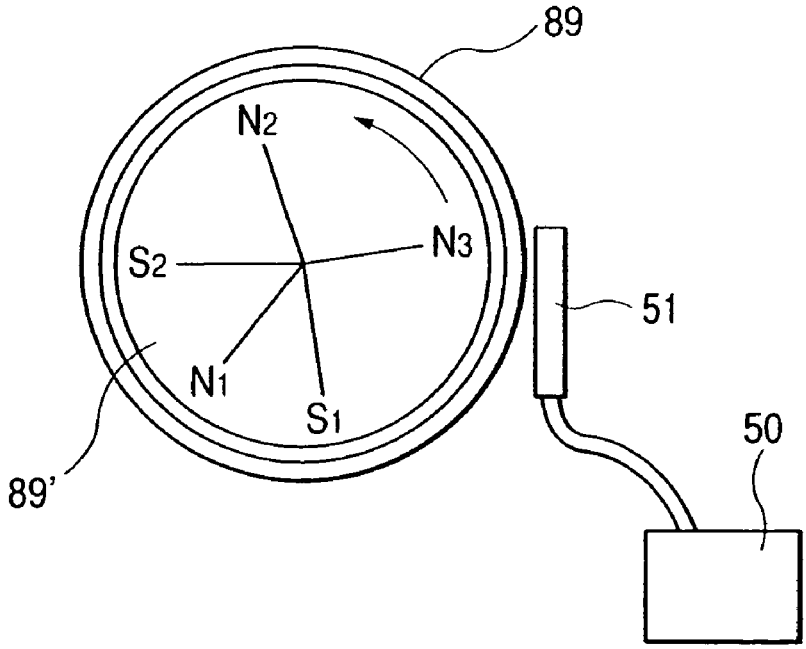
FIG. 6 illustrates a method of measuring a magnetic field on the developer bearing member according to the present invention.
Figure 7:
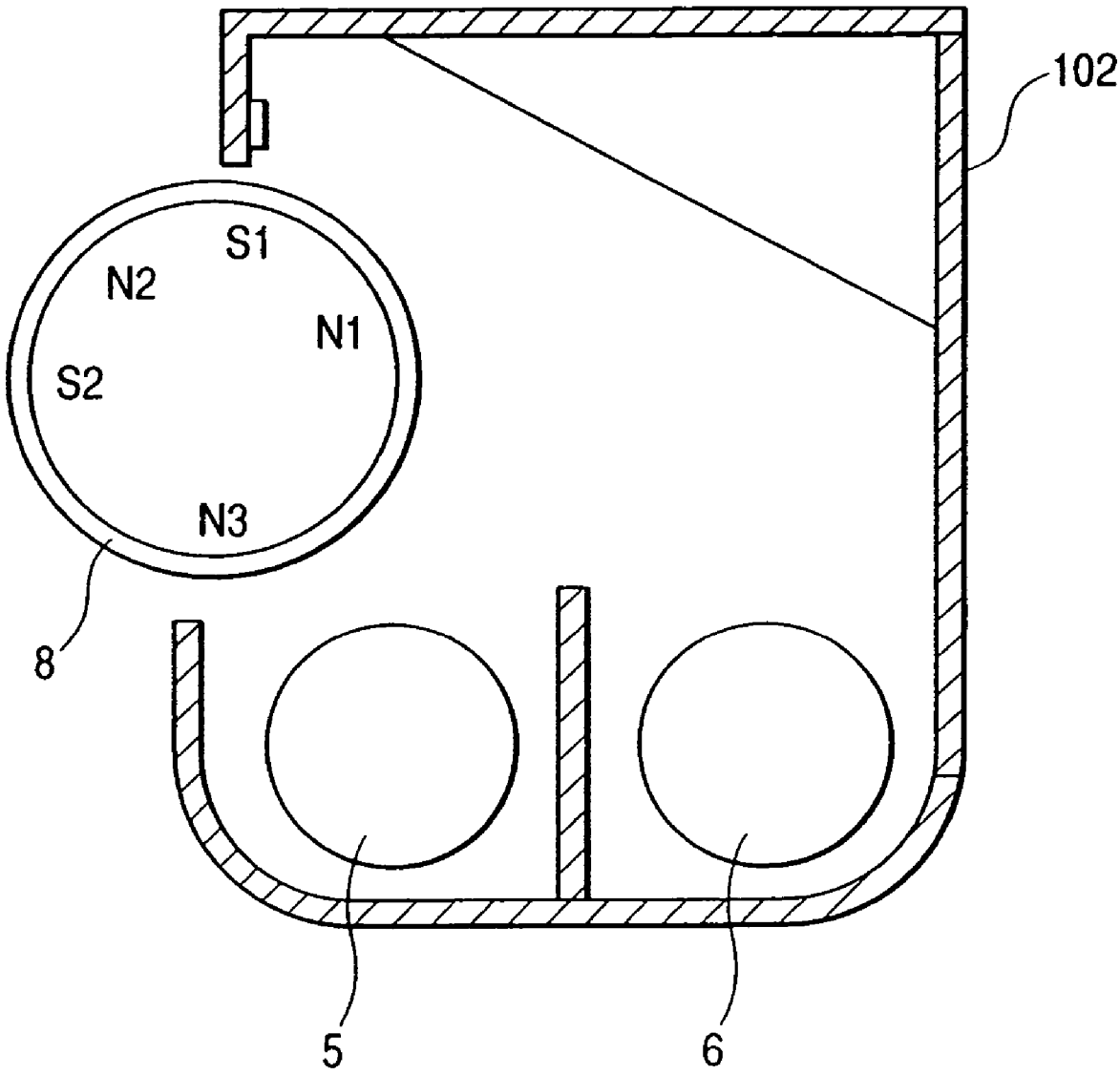
FIG. 7 PRIOR ART
FIG. 7 is a cross sectional view showing a developing apparatus according to a conventional art.
Figure 8:
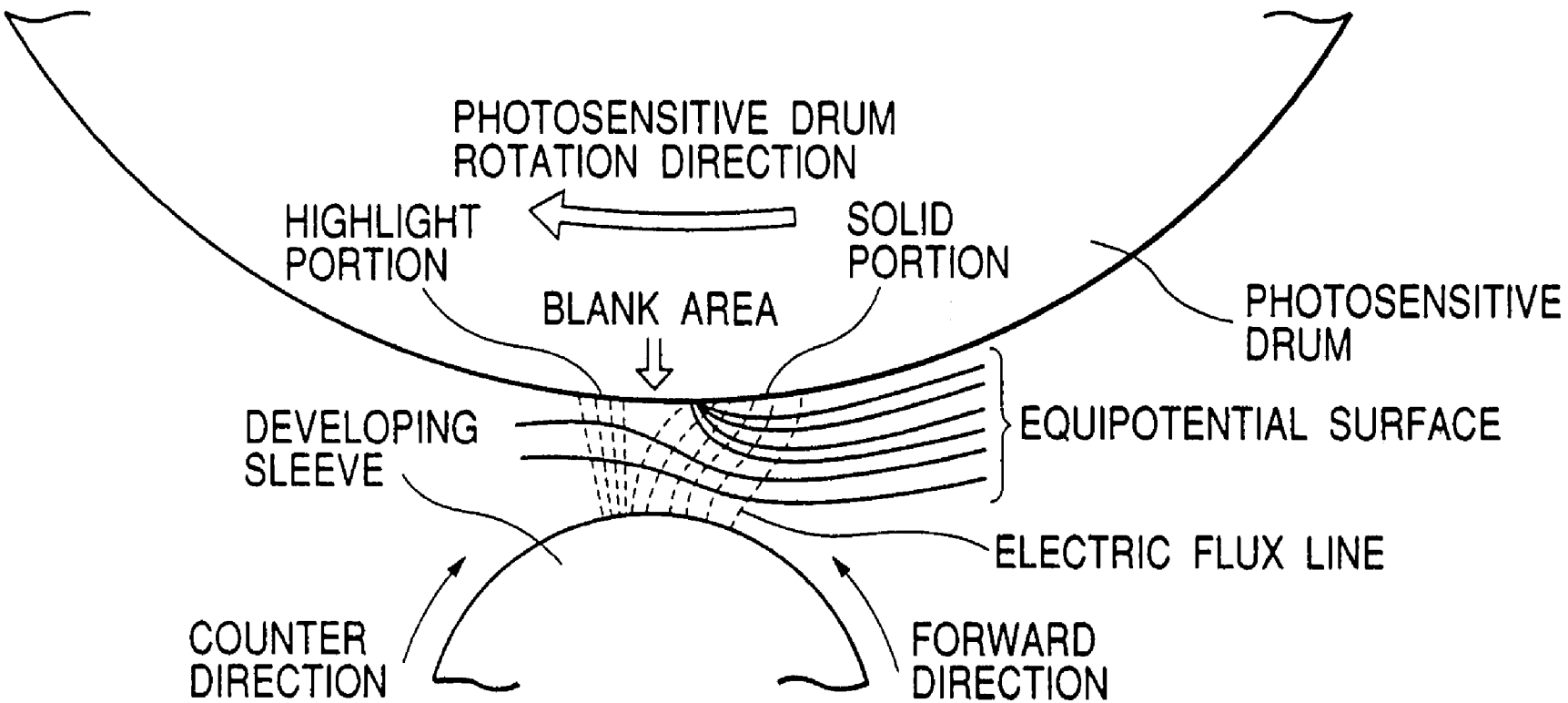
FIG. 8 is a diagram for illustrating a generation mechanism of blank areas.

The aforementioned intensities of magnetic field Br and Bθ can be measured by the process shown in FIGS. 5 and 6.

FIG. 5 illustrates a method of measuring the magnetic flux density Br in the normal line direction at an arbitrary position on the surface of a non-magnetic cylinder (or a developing sleeve) 89 that represents the developing sleeve 8, 9. The measurement is performed using a gaussmeter Model 640 manufactured by Bell.

In the arrangement shown in FIG. 5, the developing sleeve 89 is fixed in a horizontal orientation and a magnet (i.e. magnetic field generating means) 89' in the interior of the developing sleeve 89 is rotatably mounted. An axial probe 51 is secured to be in a horizontal orientation while maintaining a very small distance (set to 100 μm in the present measurement) from the developing sleeve 89 so that the center of the developing sleeve 9 and the center of the probe 51 are on substantially the same horizontal plane. The axial probe 51 is connected to a gaussmeter 50 so that the magnetic flux density on the surface of the developing sleeve 89 is measured.

The developing sleeve 89 and the magnet 89' are substantially concentric cylinders, and therefore the space between the developing sleeve 89 and the magnet 89' may be considered to be constant at any position. Therefore, the magnetic flux density Br in the normal line direction on the surface of the developing sleeve 89 can be measured for all of the circumferential positions by rotating the magnet 89'.

FIG. 6 illustrates a method of measuring the magnetic flux density Bθ in the tangential line direction on the surface of the developing sleeve 89. In this arrangement, the developing sleeve 89 is fixed in a horizontal orientation and the magnet 89' in the interior of the developing sleeve 89 is rotatably mounted in a manner similar to the arrangement shown in FIG. 5. The axial probe 51 is secured to be in a vertical orientation while maintaining a very small distance (in this case also, set to 100 μm) from the developing sleeve 89 so that the center of the developing sleeve 9 and the measurement center of the probe 51 are on substantially the same horizontal plane. The axial probe 51 is connected to the gaussmeter 50 so that the magnetic flux density in the tangential direction on the surface of the developing sleeve 89 is measured. In this measurement also, it is possible to measure the magnetic flux density Bθ in the tangential line direction on the surface of the developing sleeve 89 for all of the circumferential positions by rotating the magnet 89' in a manner similar to the arrangement described in connection with FIG. 5.

We measured the intensity of magnetic field on the surface of the developing sleeve 8, 9 using the gaussmeter shown in FIGS. 5 and 6 in the above-described manner. Measurement results showed that when the direction toward the center of the developing sleeve 8, 9 is taken as the positive direction, at the peak position of the gradient, with respect to the normal line direction of the developing sleeve 8, 9 of the sum of the square of the absolute value of the intensity of magnetic field (Br1, Br2) in the normal line direction of the developing sleeve 8, 9 and the square of the absolute value of the intensity of magnetic field (Bθ1, Bθ2) in the tangential line direction of the developing sleeve 8, 9 (i.e. at the respective peak position of Fr1 or Fr2), Fr1 was stronger than Fr2. In addition, the peak positions of Fr1 and Fr2 were at the position substantially opposed to the aforementioned closest position and at the position 6 degrees away from the closest position in the downstream direction respectively. The peak positions of Br1 and Br2 were at the position 5 degrees upstream of the aforementioned closest portion.

Incidentally, development efficiency can be further enhanced by applying an oscillating bias voltage in which a DC voltage is superimposed on an AC voltage to the developing sleeves 8 and 9. In this embodiment, the dark portion electric potential of the photosensitive drum 10 is set to −6000 V, the bright portion electric potential is set to −100 V, and a developing bias composed of a DC bias of −450 V and an AC bias with a peak-to-peak voltage Vpp of 1.85 kV and a frequency Frq. of 12 kHz is applied to each of the developing sleeves 8 and 9. As per the above, the reversal development process is used in this embodiment.

While the above description of the embodiment has been directed to a developing apparatus that performs a developing process using a two component developer as a magnetic developer composed of a non-magnetic toner and a magnetic carrier, the present invention can also be applied to a developing apparatus that performs a developing process using a single component developer composed of a magnetic toner as a magnetic developer. In the case that the present invention is applied to a developing apparatus using a two component developer, it is possible to solve the problem inherent to the developing apparatus using a two component developer, that is, the problem that the carrier that constitutes a magnetic brush in the second developing process has a counter charge (generated due to an unbalance charge state of the carrier caused by flying-away of toner to the photosensitive drum) and such carrier brought into contact with the photosensitive drum removes toner from the toner image electro-statically to cause the scavenging phenomenon.

Furthermore, while the above description of the embodiment has been directed to a developing apparatus in which magnetic developer is transferred from the first developing sleeve to the second developing sleeve, the present invention can also be applied to a developing apparatus in which the first developing sleeve and the second developing sleeve pick up to bear developer in a developing container independently from each other with transporting paths of developer via developing portions being formed respectively.

COMPARATIVE EXAMPLE 1

In this comparative example, the peak values of the gradient Fr, with respect to the direction orthogonal to the surface of the developing sleeve 8, 9 (where the direction toward the center of the sleeve is taken as positive (i.e. plus)), of the sum of the square of the absolute value of Br and the square of the absolute value of Bθ for the forces acting in the direction orthogonal to the surface of the sleeves 8 and 9 on the surface of the sleeves 8 and 9 respectively, were set substantially the same, that is, the peak values of the forces acting on developer were set substantially the same. In addition, the position of the peaks were arranged to be at the opposed portion of the respective developing sleeves 8 and 9 and the photosensitive drum 10. Namely, both the peak positions were at the same position in relation to the respective developing portions 12 and 13. With the above-arrangement, development efficiency was improved, but the blank area level was deteriorated.

COMPARATIVE EXAMPLE 2

In this comparative example, the peak values of the gradient, with respect to the direction orthogonal to the surface of the developing sleeve 8, 9 (where the direction toward the center of the sleeve is taken as positive (i.e. plus)), of the sum of the square of the absolute value of Br and the square of the absolute value of Bθ for the forces Fr1 and Fr2 acting in the direction orthogonal to the surface of the sleeves 8 and 9 on the surface of the sleeves 8 and 9 respectively, were set substantially the same, that is, the peak values of the forces acting on developer were set substantially the same. In addition, the positions of the peaks were arranged to be at a positions 5 degrees upstream of the opposed portion of the respective developing sleeves 8 and 9 and the photosensitive drum 10 with respect to the rotation direction of the developing sleeves 8 and 9. With the above arrangement, both development efficiency and blank area level were deteriorated.

While the present invention has been described with reference to embodiments to which the invention can be applied, it is apparent that the present invention may be applied to various modifications of those embodiments within the scope and spirit of the invention.

What is claimed is:

1. A developing apparatus for developing an electrostatic image formed on an image bearing member, comprising:

a first developer bearing member having a cylindrical shape for bearing and conveying magnetic developer to a first developing portion to develop the electrostatic image;

first magnetic field generating means stationarily provided in said first developer bearing member;

a second developer bearing member having a cylindrical shape for bearing and conveying the magnetic developer to a second developing portion downstream of the first developing portion in a movement direction of the image bearing member to develop the electrostatic image, said second developer bearing member developing the electrostatic image developed by said first developer bearing member; and second magnetic field generating means stationarily provided in said second developer bearing member, wherein a peak position of a magnetic force in a direction perpendicular to a surface of said second developer bearing member is set in a range of 5° to 10° on a downstream side of a portion closest to said image bearing member with respect to a rotating direction of said second developer bearing member, and wherein the magnetic force is defined by differentiating partially a value of $(Br^2+B\theta^2)$ with respect to the perpendicular direction, where Br is a component, perpendicular to the surface of said second developer bearing member, of a magnetic flux density caused by said second magnetic field generating means, and where $B\theta$ is a component, tangential to the surface of said second developer bearing member, of the magnetic flux density caused by said second magnetic field generating means.

2. A developing apparatus according to claim 1, wherein a position at which a magnetic force on a surface of said first developer bearing member has its peak is arranged to be in a vicinity of a portion at which said first developer bearing member and said image bearing member are closest to each other.

3. A developing apparatus according to either claim 1 or 2, wherein the magnetic developer is a mixture of non-magnetic toner and magnetic carrier.

4. A developing apparatus according to claim 3, wherein said first developer bearing member and said second developer bearing member are provided in such a way as to be rotatable in the same direction, and said second developer bearing member transports the magnetic developer that has been transferred from said first developer bearing member to said portion closest to said image bearing member.

* * * * *

UNITED STATES PATENT AND TRADEMARK OFFICE

CERTIFICATE OF CORRECTION

PATENT NO. : 7,054,584 B2
APPLICATION NO. : 11/166111
DATED : May 30, 2006
INVENTOR(S) : Fumitake Hirobe It is certified that error appears in the above-identified patent and that said Letters Patent is hereby corrected as shown below:

ON THE TITLE PAGE

At Item (54), Title, "MEMBERS" should read --MEMBER--.

COLUMN 1

Line 6, "MEMBERS" should read --MEMBER--.

COLUMN 4

Line 47, "cross sectional" should read --cross-sectional--.

COLUMN 18

Line 18, "is" should be deleted.

Signed and Sealed this

Twelfth Day of December, 2006

JON W. DUDAS
*Director of the United States Patent and Trademark Office*